US008235126B2

(12) United States Patent
Bradley

(10) Patent No.: US 8,235,126 B2
(45) Date of Patent: Aug. 7, 2012

(54) TRANSPORTABLE WELL SERVICE PLATFORM

(75) Inventor: Clay Albert Bradley, Okotoks (CA)

(73) Assignee: Colter Energy Services Inc., Okotoks (CA)

( * ) Notice: Subject to any disclaimer, the term of this patent is extended or adjusted under 35 U.S.C. 154(b) by 283 days.

(21) Appl. No.: 12/707,541

(22) Filed: Feb. 17, 2010

(65) Prior Publication Data

US 2010/0244404 A1 Sep. 30, 2010

Related U.S. Application Data

(60) Provisional application No. 61/164,164, filed on Mar. 27, 2009.

(51) Int. Cl.
*E21B 15/00* (2006.01)

(52) U.S. Cl. ..... 166/379; 166/75.11

(58) Field of Classification Search ..... 166/379, 166/75.11; 175/85; 182/69.6; 173/184, 173/28

See application file for complete search history.

(56) References Cited

U.S. PATENT DOCUMENTS

| | | | | |
|---|---|---|---|---|
| 2,617,500 | A | 11/1952 | Cardwell et al. | |
| 2,662,797 | A | 12/1953 | Moon | |
| 4,572,328 | A | 2/1986 | Benko | |
| 5,299,653 | A | 4/1994 | Nebel | |
| 5,711,382 | A * | 1/1998 | Hansen et al. | 175/52 |
| 6,848,539 | B2 | 2/2005 | Lee et al. | |
| 7,191,839 | B2 | 3/2007 | Carriere et al. | |
| 7,249,629 | B2 | 7/2007 | Cunningham et al. | |
| 7,293,607 | B2 | 11/2007 | Lambert et al. | |
| 7,469,749 | B2 * | 12/2008 | Folk | 166/379 |
| 2006/0011351 | A1 * | 1/2006 | Lambert et al. | 166/379 |
| 2011/0253476 | A1 * | 10/2011 | Earl et al. | 182/69.6 |

* cited by examiner

*Primary Examiner* — Hoang Dang
(74) *Attorney, Agent, or Firm* — Bennett Jones LLP

(57) ABSTRACT

A transportable well service platform and method are provided. The transportable well service platform can have a main platform and a work platform. The work platform can be movable substantially vertically relative to the main platform. The well site platform can be transported to a well site and positioned at the well site relative to a well head so completion work can be performed on the well. The work platform can be moved vertically relative to the main platform to a desired height relative to the well head to perform the completion work.

76 Claims, 4 Drawing Sheets

TRANSPORTABLE WELL SERVICE PLATFORM

CROSS REFERENCE TO RELATED APPLICATIONS

The present application claims priority under 35 U.S.C. §119(e) to U.S. provisional patent application No. 61/164,164 filed Mar. 27, 2009.

FIELD OF THE INVENTION

The present invention relates to a transportable service rig for performing completions on oil, gas or other wells.

BACKGROUND OF THE INVENTION

Typically, after a well, such as a gas well, oil well, etc., is drilled, additional steps are done to complete the well and make it suitable for producing gas, oil, etc. or for injection. This is typically referred to as the "well completion". Performing a well completion can include the steps of: running in production tubing and its associated components, perforating the well casing, stimulating the well, logging, swabbing, etc.

To drill the well, a drilling rig is typically used. These drilling rigs are typically large, heavy and specially constructed to perform the drilling steps. Because of the specialization and complexity of these drilling rigs, the completion steps are often carried out after the drilling rig has been removed by a smaller set of platforms. In some cases, these platforms might be assembled around the well at site. In other cases, various types of mobile platforms have been used. Because the height of the well head can vary from well to well, these platforms must be able to accommodate these different heights.

SUMMARY OF THE INVENTION

In an aspect, a transportable well service platform is provided that is adapted to be set up at a well site around a well head relatively quickly and be able to accommodate well heads having various heights.

In an aspect, a transportable well service platform is provided. The service platform comprises: a main platform having a first end and a second end; a frame supporting the main platform; transport wheels attached to the frame; and a work platform having a first end and a second end provided above the main platform, the work platform movable substantially vertically relative to the main platform.

To use the transportable well service platform, it is backed up so that a well head extends through the aperture in the work platform. The work platform can then be raised or lowered to the desired height to perform completion jobs on the well head at an accommodating height.

In an aspect, a self leveling staircase can be provided between the work platform and the main platform. The self leveling staircase can maintain treads of the staircase in a substantially horizontal position as the work platform is raised and lowered relative to the main platform.

In an aspect, stabilizer members can be attached to a back end of the main platform and moved between a transport position where they can act as a bumper for the transportable well service platform during transportation and then placed in an extended position where they can act to help stabilize the transport well service platform when it is in position at a well site.

In another aspect, a method of providing a work service platform at a well site is provided. The method comprises: providing a well service platform having a main platform and a work platform; transporting the well service platform to the well site and positioning the work platform relative to a well head at the well site; and moving the work platform substantially vertically relative to the main platform to a first desired height relative to the well head.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
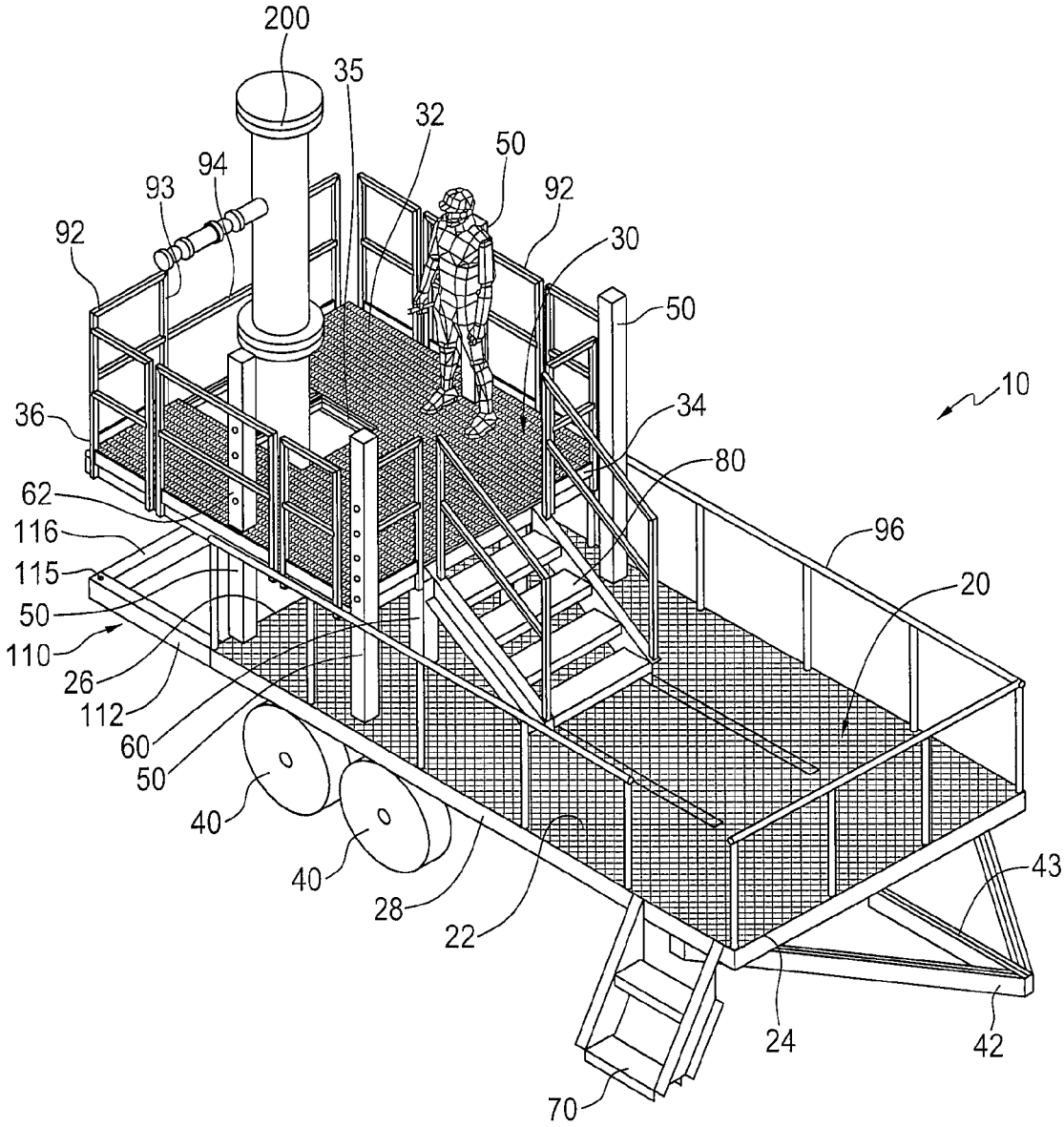
FIG. 1 is a perspective view of a transportable well service platform.
Figure 2:
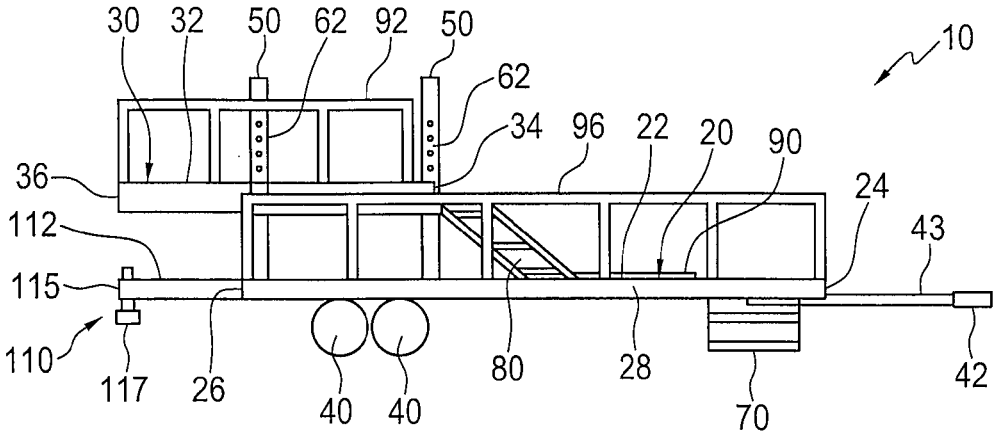
FIG. 2 is a side view of the transportable well service platform of FIG. 1.
Figure 3:
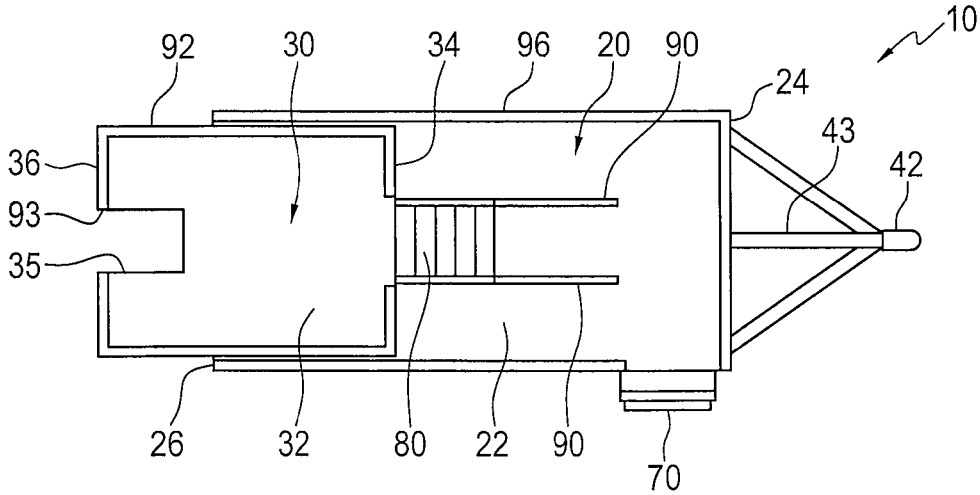
FIG. 3 is a top view of the transportable well service platform of FIG. 1.

FIGS. 1-3 illustrate a transportable well service platform 10. The transportable well service platform 10 allows for attachment to a vehicle so that the transportable well service platform 10 can be transported to a well site and installed in place at the well so that the well can be completed.

The transportable well service platform 10 can have a main platform 20 having a top surface 22, a first end 24 and a second end 26. The main platform 20 can be supported by a frame 28. Transport wheels 40 can be attached to the frame 28. A coupler 42, for attaching the transportable well service platform 10 to a hitch on a tow vehicle (not shown), can be provided on a tongue 43 attached to first end 24 of the main platform 20 so that the transportable well service platform 10 can be hitched to the tow vehicle and transported to different well sites.

A work platform 30 having a first end 34 and a second end 36 can be provided above the main platform 20 and movable substantially vertically relative to the main platform 20. In one aspect, the work platform 30 can be positioned relative to the main platform 20 so that the work platform 30 extends past the second end 26 of the main platform 20. In this manner, a portion of the work platform 20 overhangs the second end 26 of the main platform 20. A number of guide members 50 can be provided secured to the main platform 20. The work platform 30 can be slidably attached to the guide members 50 so that the work platform 20 can slide up and down along the guide members 50. In one aspect, the guide members 50 are oriented substantially perpendicular to the main platform 20 so that they extend substantially vertically when the main platform 20 is substantially horizontal. A lifting device 60, such as one or more screw jacks, hydraulic cylinders, etc. can be provided to raise and lower the work platform 30 relative to the main platform 20. In one aspect, a series of positioning apertures 62 can be provided running along a length of the guide members 50 allowing pins (not shown) to be inserted through the positioning apertures 62 in the guide members 50 to hold the work platform 30 in place when it has been raised to the desired height by the lifting device 50.

The work platform 30 could be provided with a top surface 32 allowing people to walk around the work platform 30 and place equipment, machinery, etc. on this top surface 32. Additionally, the work platform 30 could be provided with an aperture 35 open at the second end 36 of the work platform 30 and extending towards the first end 34. In one aspect, the aperture 35 is sized to accept a well head 200 so that the transportable well service platform 10 can be backed up so that the well head 200 extends through the aperture 35 in the work platform 30. In one aspect, the aperture 35 does not extend beyond the portion of the work platform 30 that overhangs the second end 26 of the main platform 20, such that the aperture 35 stops before it reaches the second end 26 of the main platform 20. In one aspect, the top surface 32 of the work platform 30 can be made up of a number of removable plates so that the aperture 35 can be opened, closed or moved around the work platform 30.

A first staircase 70 can be provided leading up from the ground surface to the main platform 20 of the transportable well service platform 10.

Figure 4:
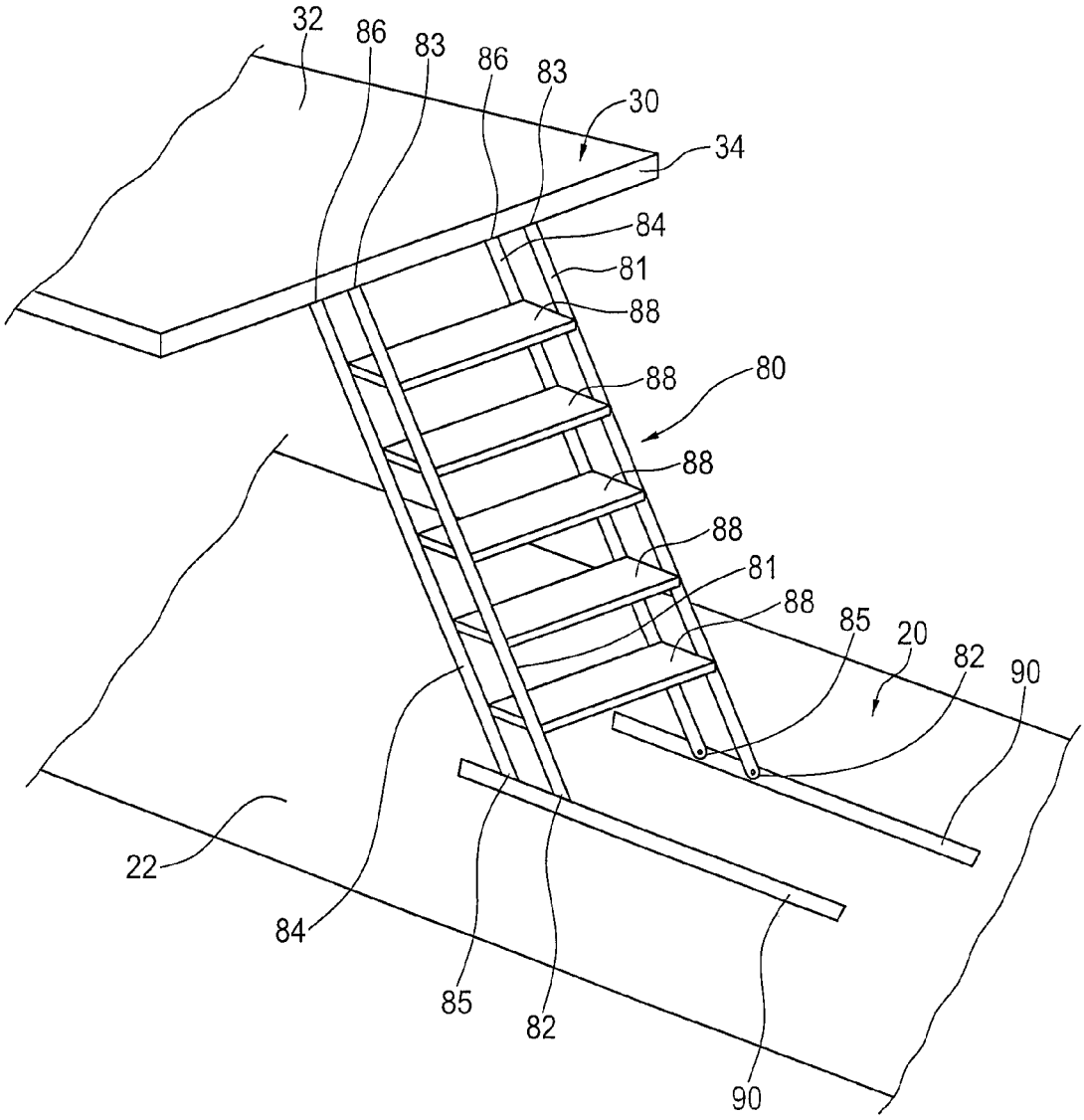
FIG. 4 is a fragmentary view of leveling stair provided between a work platform and a main platform of the transportable well service platform shown in FIG. 1.

A leveling staircase 80 can be provided leading between the top surface 22 of the main platform 20 and the top surface 32 of the work platform 30. FIG. 4 illustrates a fragmentary view of the leveling staircase stairs 80. The leveling staircase stairs 80 can have a pair of front supports 81, a pair of rear supports 84 and a number of treads 88 extending between the pair of front supports 81 and the pair of rear supports 84. Each of the treads 88 can be rotatably connected to the pair of front supports 81 at a front end of the treads and rotatably connected to the pair of back supports 84 at a back end of the treads. Bottom ends 82 of the pair of front supports 81 and bottom ends 85 of the rear supports 84 are rotatably and slidably attached to a pair of rails 90 running along the top surface 22 of the main platform 20 so that the bottom ends 82 of the pair of front supports 81 and the bottom ends 85 of the pair of rear supports 84 can slide and rotate relative to the rails 90. Top ends 83 of the front supports 81 and top ends 86 of the rear supports 84 are rotatably attached to the work platform 30. In one aspect, the front supports 81 and the rear supports 84 are positioned so that they remain parallel to each other even though they may move closer together or further apart, even as the front supports 81 and the rear supports 84 slide along the rails 90 on the main platform 20. In this manner, as the work platform 30 is raised or lowered, the treads 88 of the leveling staircase 80 can maintain a substantially horizontal orientation allowing a person to ascend to or descend from the work platform 30 no matter what height the work platform 30 is raised relative to the main platform 20.

Referring again to FIGS. 1-3, in an aspect, upper railings 92 can be provided around a periphery of the work platform 30 to prevent a person, machinery, other objects, etc. from falling off the work platform 30. If the work platform 30 is provided with the aperture 35, the upper railing 92 can have an opening 93 provided in the upper railings 92 above the second end 36 of the work platform 30 where the aperture 35 extends out the second end 36 of the work platform 30. In this manner, the transportable well service platform 10 can be backed up so that a well head 200 can pass through the opening 93 in the upper railings 92 and into the aperture 35. In a further aspect, connecting links 94 connectable to the upper railing 92 on each side of the opening 93 can be provided. These connecting links 94 can be removed so that the transportable service rig 10 can be backed up so that the well head 200 positioned in the aperture 35. Once the well head 200 is positioned in the aperture 35, the connecting links 94 can be provided across the opening 93 of the upper railing 92, closing off the opening 93, while work is being performed on the well head 200 from the work platform 30.

Lower railings 96 can be provided around a periphery of the main platform 20 as a barrier to try and prevent people and/or equipment from falling off of the main platform 20.

Figure 5:
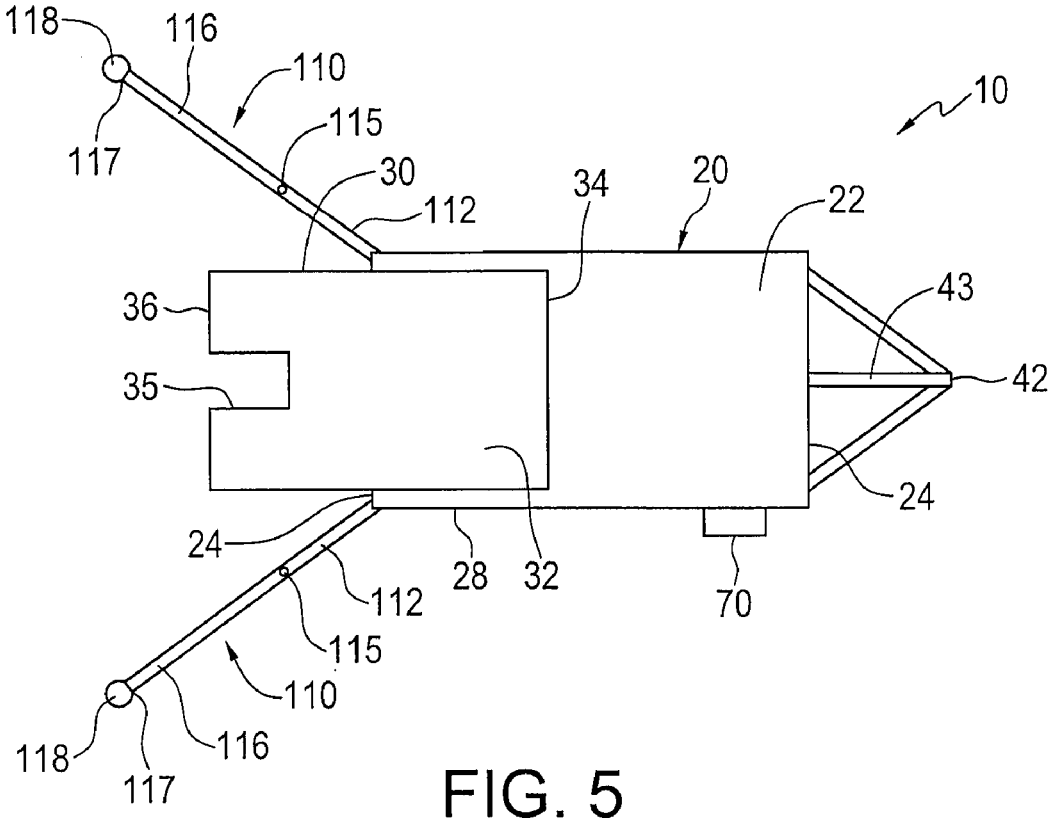
FIG. 5 is a top view of a the work platform with stabilizer members in an extended position.
Figure 6:
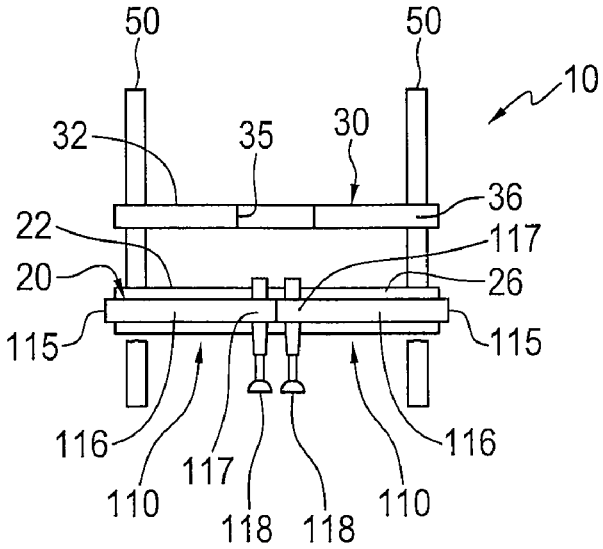
FIG. 6 is a rear view of the stabilizer members in a folded position for transport.

In an aspect, stabilizing members 110 can be provided. FIGS. 5 and 6 are views of the transportable service well platform 10 showing the stability members 110. FIG. 5 illustrates the stability members 110 in an extended position when the transportable well service platform 10 is being used to complete a well. FIG. 6 illustrates the stabilizing members 110 in a folded position for transport. These stabilizing members 110 can have first links 112 pivotally connected to the second end 36 of the frame 28. Second links 116 can be pivotally connected to the first links 112 with a connection point 115 and have extendable legs 118 provided at the ends 117 of the second links 116. In one aspect, the first links 112 can be made long enough so that when they are placed extending backwards from the frame 28 they extend beyond the second end 36 of the work platform 30. The second links 116 can be made long enough so that when the second links 116 are pivoted at substantially right angles to the first links 112 that are pivoted to extend behind the main platform 20, ends 117 of the second links 116 can be placed adjacent to each other. In one aspect, the ends 117 of the second links 116 can be made to be connectable to each other. In this manner, when the transportable well service platform 10 is going to be transported, the stabilizer members 110 can be placed in their transport position, as shown in FIG. 6, extending beyond the second end 36 of the work platform 30 and serve as a bumper for the transportable well service platform 10.

When the transportable well service platform 10 is provided at a well site, the stabilizer members 110 can be placed in their extended position, as shown in FIG. 5, and used as stabilizers/supports for the transportable well service platform 10. The second links 116 can be disconnected from each other and pivoted to lie in line with the first links 112. The first links 112 can be pivoted to extend at an angle from the frame 28, extending out from the sides of the main platform 10, as shown in FIG. 5. The extendable legs 118 provided on the ends 117 of the second link 116 can then be adjusted until they come into contact with the ground surface. With the stabilizer members 110 angled outwards from the frame 28, they can add stability/provide support to the transportable well service platform 10 while it is set up and in use.

Referring again to FIGS. 1-6, in operation the transportable well service platform 10 can be hitched to a vehicle and transported to a well site. Once at the well site, the transportable well service platform 10 can be backed up so that the well head 200 is positioned in the aperture 35 of the work platform 30. When the well head 200 is positioned in the aperture 35, the transportable well service platform 10 can be disconnected from the tow vehicle. The stabilizing members 110 can be disconnected from each other and folded to their extended position and the extendable legs 118 on the ends 117 of the second links 116 can then be extended downwards until they are placed in contact with the ground surface.

The work platform 30 can be raised to the desired height to perform completion services on the well head 200. Typically, the work platform 30 may be lowered adjacent to the main platform 20 during transportation of the transportable service well platform 10, so with the transportable well service platform 10 in the desired position and the well head 200 positioned in the aperture 35, the work platform 30 can be raised to the desired height to perform the desired services on the well. The lifting mechanism 60 can be engaged to raise the work platform 30 to the desired height and then once at the desired height, if the guide members 50 are provided with positioning apertures 62, pins can be inserted into the proper positioning aperture 62 to hold the work platform 30 at the desired height. As the platform 30 is raised, it moves upwards substantially vertically relative to the main platform 20. In this manner, the well head 200 remains in substantially the same position relative to the aperture 35 as the work platform 30 is raised and lowered.

As the work platform 30 is being raised by the lifting mechanism 60, the leveling staircase 80 provided between the work platform 30 and the main platform 10 maintains the treads 88 of the leveling staircase 80 substantially horizontally even though the angle of the leveling staircase 80 increases as the work platform 30 is raised With the work platform 30 raised to the desired height, a person can access the work platform 30 by climbing the first staircase 70 from the ground surface to the main platform 20, walking across the main platform 20 to the leveling staircase 80 and then ascending the leveling staircase 80 to the work platform 30.

Using the raised work platform 30, work, such as completion work, can be performed on the well.

If another height is desired for the work platform 30, which could occur when one completion job has been completed and other is to be performed where a different height is desirable or required, the work platform 30 can be relatively quickly lowered or raised to the new height by engaging the lifting mechanism 60 to either raise or lower the work platform 30. As the work platform 30 is being raised or lowered, the leveling staircase 80 maintains the treads 88 at a substantially horizontal position, even though the angle of the leveling staircase 80 is changing. If positioning apertures 62 are provided on the guide members 50 and pins are inserted in the positioning apertures 62, the pins are removed before the work platform 30 is lowered. Once the work platform 30 is at the new height, the pins can be inserted into the proper positioning apertures 62 so that the work platform 30 is held at the new position. In this manner, the work platform 30 can relatively quickly be raised and lowered to varying heights depending on the height desired for the work platform 30.

When the transportable service well platform 10 is no longer required at a well site, it can easily be placed in position for transport and moved to another location, such as the next well site requiring a completion to be performed. The work platform 30 can be lowered adjacent to the main platform 20, the stabilizing members 110 can be folded into their transport position and the coupler 42 attached to the hitch (not shown) of a tow vehicle (not shown). The tow vehicle can then tow the transportable service well platform 10 to the next desired location, such as a storage facility, next well site, etc.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A transportable well service platform comprising:

a main platform having a first end and a second end;

a frame supporting the main platform;

transport wheels attached to the frame;

a work platform having a first end and a second end provided above the main platform, the work platform movable substantially vertically relative to the main platform; and guide members slidably attached to the work platform to guide the work platform in vertical motion.

2. The well service platform of claim 1 having a coupler for attaching the well service platform to a tow vehicle for transport.

3. The well service platform of claim 1 wherein the second end of the work platform extends past the second end of the main platform defining an overhang.

4. The well service platform of claim 1 wherein the guide members are oriented substantially vertically to the main platform.

5. The well service platform of claim 1 further comprising a lifting device to raise and lower the work platform relative to the main platform.

6. The well service platform of claim 3 further comprising an aperture in the work platform sized to allow a well head to pass up through the work platform.

7. The well service platform of claim 6 wherein the aperture is open at the second end of the work platform and extends towards the first end of the work platform.

8. The well service platform of claim 7 wherein the aperture is provided on the overhang of the work platform.

9. The well service platform of claim 1 wherein the work platform comprises removable plates.

10. The well service platform of claim 1 further comprising a leveling staircase between the work platform and the main platform, the leveling staircase having treads and operative to keep the treads of the leveling staircase substantially horizontal as the work platform is moved vertically relative to the main platform.

11. The well service platform of claim 10 wherein the leveling platform has at least one front support connected to a front end of each tread and at least one rear support connected to a back end of each tread, bottom ends of the at least one front support and the at least rear support are rotatably and slidably attached to the main platform and top ends of the at least one front support and the at least one rear support are attached to the work platform.

12. The well service platform of claim 7 further comprising a railing positioned at a periphery of the work platform, the railing having an opening positioned to correspond with the aperture in the work platform.

13. The well service platform of claim 12 further comprising connecting links to connect to the railing and close the opening in the railing.

14. The well service platform of claim 1 further comprising stabilizing members, the stabilizing members positionable in an extended position where the stabilizing members are angled outwards from the frame and in a transport position.

15. The well service platform of claim 14 wherein each stabilizing member comprises a first link, a second link and extendable legs, a first end of the first link pivotally attached to the frame and a second end of the first link pivotally attached to the second link, the extendable legs connected to the second end of the second link.

16. The well service platform of claim 15 wherein the first link has a length greater than the overhang of the work platform, so that when the stabilizing members are positioned in the transport position extending from the second end of the main platform, the second ends of the first links extend past the second end of the work platform.

17. The well service platform of claim 16 wherein the second links can be connected to each other to form a bumper for the well service platform when the stabilizer members are in the transport position.

18. A method of providing a work service platform at a well site comprising:

providing a well service platform having a main platform and a work platform;

transporting the well service platform to the well site and positioning the work platform relative to a well head at the well site; and moving the work platform substantially vertically relative to the main platform to a first desired height relative to the well head, wherein a second end of the work platform extends past a second end of the main platform and wherein an aperture is provided in the work platform, the aperture having an opening at the second end of the work platform and wherein the well service platform is moved so that the well head passes through the opening of the aperture before the well service platform is positioned relative to the work platform so that the well head is positioned within the aperture.

19. The method of claim 18 further comprising, after the work platform is moved to the first desired height, moving the work platform substantially vertically relative to the main platform to a second desired height relative to the well head, the second desired height different than the first desired height.

20. The method of claim 18 wherein the well service platform is provided with stabilizer members placed in a transport positioned while the well service platform is being transported and then the stabilizer bars are placed in an extended position angling outwards from the well service platform when the well service platform is positioned at the well site.

21. The method of claim 20 wherein the stabilizer members include extendable legs that are extended so that they contact a ground surface at the well site.

22. The method of claim 18 wherein the well service platform is provided with transport wheels and is transported using a tow vehicle.

23. A transportable well service platform comprising:

a main platform having a first end and a second end;

a frame supporting the main platform;

transport wheels attached to the frame;

a work platform having a first end and a second end provided above the main platform, the work platform movable substantially vertically relative to the main platform; and an aperture in the work platform sized to allow a well head to pass up through the work platform, wherein the second end of the work platform extends past the second end of the main platform defining an overhang, and wherein the aperture is open at the second end of the work platform and extends towards the first end of the work platform.

24. The well service platform of claim 23 having a coupler for attaching the well service platform to a tow vehicle for transport.

25. The well service platform of claim 23 further comprising guide members slidably attached to the work platform to guide the work platform in vertical motion.

26. The well service platform of claim 25 wherein the guide members are oriented substantially vertically to the main platform.

27. The well service platform of claim 23 further comprising a lifting device to raise and lower the work platform relative to the main platform.

28. The well service platform of claim 23 wherein the aperture is provided on the overhang of the work platform.

29. The well service platform of claim 23 wherein the work platform comprises removable plates.

30. The well service platform of claim 23 further comprising a leveling staircase between the work platform and the main platform, the leveling staircase having treads and operative to keep the treads of the leveling staircase substantially horizontal as the work platform is moved vertically relative to the main platform.

31. The well service platform of claim 30 wherein the leveling platform has at least one front support connected to a front end of each tread and at least one rear support connected to a back end of each tread, bottom ends of the at least one front support and the at least rear support are rotatably and slidably attached to the main platform and top ends of the at least one front support and the at least one rear support are attached to the work platform.

32. The well service platform of claim 23 further comprising a railing positioned at a periphery of the work platform, the railing having an opening positioned to correspond with the aperture in the work platform.

33. The well service platform of claim 32 further comprising connecting links to connect to the railing and close the opening in the railing.

34. The well service platform of claim 23 further comprising stabilizing members, the stabilizing members positionable in an extended position where the stabilizing members are angled outwards from the frame and in a transport position.

35. The well service platform of claim 34 wherein each stabilizing member comprises a first link, a second link and extendable legs, a first end of the first link pivotally attached to the frame and a second end of the first link pivotally attached to the second link, the extendable legs connected to the second end of the second link.

36. The well service platform of claim 35 wherein the first link has a length greater than the overhang of the work platform, so that when the stabilizing members are positioned in the transport position extending from the second end of the main platform, the second ends of the first links extend past the second end of the work platform.

37. The well service platform of claim 36 wherein the second links can be connected to each other to form a bumper for the well service platform when the stabilizer members are in the transport position.

38. A method of providing a work service platform at a well site comprising:

providing a well service platform having a main platform and a work platform;

transporting the well service platform to the well site and positioning the work platform relative to a well head at the well site; and moving the work platform substantially vertically relative to the main platform to a first desired height relative to the well head, wherein the well service platform is provided with stabilizer members placed in a transport positioned while the well service platform is being transported and then the stabilizer bars are placed in an extended position angling outwards from the well service platform when the well service platform is positioned at the well site.

39. The method of claim 38 further comprising, after the work platform is moved to the first desired height, moving the work platform substantially vertically relative to the main platform to a second desired height relative to the well head, the second desired height different than the first desired height.

40. The method of claim 38 wherein a second end of the work platform extends past a second end of the main platform.

41. The method of claim 38 wherein the stabilizer members include extendable legs that are extended so that they contact a ground surface at the well site.

42. The method of claim 38 wherein the well service platform is provided with transport wheels and is transported using a tow vehicle.

43. A transportable well service platform comprising:

a main platform having a first end and a second end;

a frame supporting the main platform;

transport wheels attached to the frame;

a work platform having a first end and a second end provided above the main platform, the work platform movable substantially vertically relative to the main platform; and a leveling staircase between the work platform and the main platform, the leveling staircase having treads and operative to keep the treads of the leveling staircase substantially horizontal as the work platform is moved vertically relative to the main platform.

44. The well service platform of claim 43 having a coupler for attaching the well service platform to a tow vehicle for transport.

45. The well service platform of claim 43 wherein the second end of the work platform extends past the second end of the main platform defining an overhang.

46. The well service platform of claim 43 further comprising guide members slidably attached to the work platform to guide the work platform in vertical motion.

47. The well service platform of claim 46 wherein the guide members are oriented substantially vertically to the main platform.

48. The well service platform of claim 43 further comprising a lifting device to raise and lower the work platform relative to the main platform.

49. The well service platform of claim 45 further comprising an aperture in the work platform sized to allow a well head to pass up through the work platform.

50. The well service platform of claim 49 wherein the aperture is open at the second end of the work platform and extends towards the first end of the work platform.

51. The well service platform of claim 50 wherein the aperture is provided on the overhang of the work platform.

52. The well service platform of claim 43 wherein the work platform comprises removable plates.

53. The well service platform of claim 43 wherein the leveling platform has at least one front support connected to a front end of each tread and at least one rear support connected to a back end of each tread, bottom ends of the at least one front support and the at least rear support are rotatably and slidably attached to the main platform and top ends of the at least one front support and the at least one rear support are attached to the work platform.

54. The well service platform of claim 50 further comprising a railing positioned at a periphery of the work platform, the railing having an opening positioned to correspond with the aperture in the work platform.

55. The well service platform of claim 54 further comprising connecting links to connect to the railing and close the opening in the railing.

56. The well service platform of claim 43 further comprising stabilizing members, the stabilizing members positionable in an extended position where the stabilizing members are angled outwards from the frame and in a transport position.

57. The well service platform of claim 56 wherein each stabilizing member comprises a first link, a second link and extendable legs, a first end of the first link pivotally attached to the frame and a second end of the first link pivotally attached to the second link, the extendable legs connected to the second end of the second link.

58. The well service platform of claim 57 wherein the first link has a length greater than the overhang of the work platform, so that when the stabilizing members are positioned in the transport position extending from the second end of the main platform, the second ends of the first links extend past the second end of the work platform.

59. The well service platform of claim 58 wherein the second links can be connected to each other to form a bumper for the well service platform when the stabilizer members are in the transport position.

60. A transportable well service platform comprising:

a main platform having a first end and a second end;

a frame supporting the main platform;

transport wheels attached to the frame;

a work platform having a first end and a second end provided above the main platform, the work platform movable substantially vertically relative to the main platform; and stabilizing members, the stabilizing members positionable in an extended position where the stabilizing members are angled outwards from the frame and in a transport position.

61. The well service platform of claim 60 having a coupler for attaching the well service platform to a tow vehicle for transport.

62. The well service platform of claim 60 wherein the second end of the work platform extends past the second end of the main platform defining an overhang.

63. The well service platform of claim 60 further comprising guide members slidably attached to the work platform to guide the work platform in vertical motion.

64. The well service platform of claim 63 wherein the guide members are oriented substantially vertically to the main platform.

65. The well service platform of claim 60 further comprising a lifting device to raise and lower the work platform relative to the main platform.

66. The well service platform of claim 62 further comprising an aperture in the work platform sized to allow a well head to pass up through the work platform.

67. The well service platform of claim 66 wherein the aperture is open at the second end of the work platform and extends towards the first end of the work platform.

68. The well service platform of claim 67 wherein the aperture is provided on the overhang of the work platform.

69. The well service platform of claim 60 wherein the work platform comprises removable plates.

70. The well service platform of claim 60 further comprising a leveling staircase between the work platform and the main platform, the leveling staircase having treads and operative to keep the treads of the leveling staircase substantially horizontal as the work platform is moved vertically relative to the main platform.

71. The well service platform of claim 70 wherein the leveling platform has at least one front support connected to a front end of each tread and at least one rear support connected to a back end of each tread, bottom ends of the at least one front support and the at least rear support are rotatably and slidably attached to the main platform and top ends of the at least one front support and the at least one rear support are attached to the work platform.

72. The well service platform of claim 67 further comprising a railing positioned at a periphery of the work platform, the railing having an opening positioned to correspond with the aperture in the work platform.

73. The well service platform of claim 72 further comprising connecting links to connect to the railing and close the opening in the railing.

74. The well service platform of claim 60 wherein each stabilizing member comprises a first link, a second link and extendable legs, a first end of the first link pivotally attached to the frame and a second end of the first link pivotally attached to the second link, the extendable legs connected to the second end of the second link.

75. The well service platform of claim 74 wherein the first link has a length greater than the overhang of the work platform, so that when the stabilizing members are positioned in the transport position extending from the second end of the main platform, the second ends of the first links extend past the second end of the work platform.

76. The well service platform of claim 75 wherein the second links can be connected to each other to form a bumper for the well service platform when the stabilizer members are in the transport position.

* * * * *